US005901370A

United States Patent [19]

Linday

[11] Patent Number: 5,901,370

[45] **Date of Patent: *May 11, 1999**

[54] SEGMENTED CAP ASSEMBLY

[76] Inventor: Nancy L. Linday, 17 E. 97th St., No. 1-B, New York, N.Y. 10029

[ * ] Notice: This patent is subject to a terminal disclaimer.

[21] Appl. No.: 07/860,906

[22] Filed: Mar. 31, 1992

Related U.S. Application Data

[63] Continuation-in-part of application No. 07/605,660, Oct. 29, 1990, Pat. No. 5,099,524.

[51] Int. Cl.[6] ..... A42B 1/06; A42B 1/24

[52] U.S. Cl. ..... 2/10; 2/12; 2/171.1; 2/181.4; 2/195.1; 2/195.2; 2/200.1; 2/209.13; 2/244; 2/918; 2/DIG. 11

[58] Field of Search ..... 2/10, 12, 171, 2/171.1, 171.2, 181, 181.4, 182.4, 185 R, 195, 196, 199, 209.1, 247, 251, DIG. 6, DIG. 11, 195.1, 181.2, 183, 200.1, 209.13, 918, 195.2, 244

[56] References Cited

U.S. PATENT DOCUMENTS

| | | | |
|---|---|---|---|
| 1,598,314 | 8/1926 | Rosenberg | 2/10 |
| 4,023,212 | 5/1977 | Huffman | 2/171.1 |
| 4,096,589 | 6/1978 | Goldstein | 2/12 |
| 4,131,953 | 1/1979 | Kimotsuki | 2/182.6 |
| 4,277,847 | 7/1981 | Florio | 2/199 |
| 4,365,354 | 12/1982 | Sullivan | 2/247 |
| 4,451,935 | 6/1984 | Henschel | 2/247 |
| 4,485,496 | 12/1984 | Shanks | 2/247 |
| 4,547,903 | 10/1985 | Brown | 2/199 |
| 4,630,317 | 12/1986 | Brown | 2/171 |
| 4,776,042 | 10/1988 | Hanson | 2/199 |
| 4,811,430 | 3/1989 | Janusz | 2/171 |
| 4,873,726 | 10/1989 | Tapia | 2/171.1 |
| 4,918,758 | 4/1990 | Rendina | 2/DIG. 11 |
| 4,941,210 | 7/1990 | Konucik | 2/171 |
| 4,993,079 | 2/1991 | Johnson | 2/181 |
| 5,091,995 | 3/1992 | Oates | 2/10 |
| 5,099,524 | 3/1992 | Linday | 2/171 |
| 5,136,726 | 8/1992 | Kellin | 2/195 |

FOREIGN PATENT DOCUMENTS

| | | | |
|---|---|---|---|
| 124654 | 4/1919 | United Kingdom | 2/181 |
| 2070413 | 9/1981 | United Kingdom | 2/209.1 |
| 2240029 | 7/1991 | United Kingdom | 2/195 |

*Primary Examiner*—Diana L. Biefeld

[57] ABSTRACT

A segmented cap assembly comprising a crown component, a visored headband component and at least one ornamental badge. Ornamental badge is selectively attachable to either the crown component or the headband component.

17 Claims, 4 Drawing Sheets

SEGMENTED CAP ASSEMBLY

This disclosure is a continuation-in-part of U.S. patent application Ser. No. 605,660 filed Oct. 29, 1990, now issued U.S. Pat. No. 5,099,524, which is incorporated herein.

BACKGROUND OF THE INVENTION

The present invention relates to segmented caps having detachable and interchangeable components.

Segmented caps of the prior art generally provide detachable and interchangeable components that are intended to be worn in a single configuration. Caps are often utilized as a marketing tool. It is more useful for marketing purposes that a segmented cap to be useable as a marketing tool in a variety of wear configurations.

SUMMARY OF THE INVENTION

The segment cap assembly of this invention in a preferred embodiment includes a crown component having at least a portion thereof formed from hook and loop tape hook-portion-engaging material, a visored headband component having a forehead portion formed from hook and loop tape hook-portion-engaging material, and at least one ornamental badge selectively attachable to the hook-portion-engaging material of either the crown component or the headband component. Thus, the segmented cap of the present invention is useful as a marketing tool when the headband component is worn separately or when worn in combination with the crown component.

DESCRIPTION OF PREFERRED EMBODIMENTS

Figure 1:
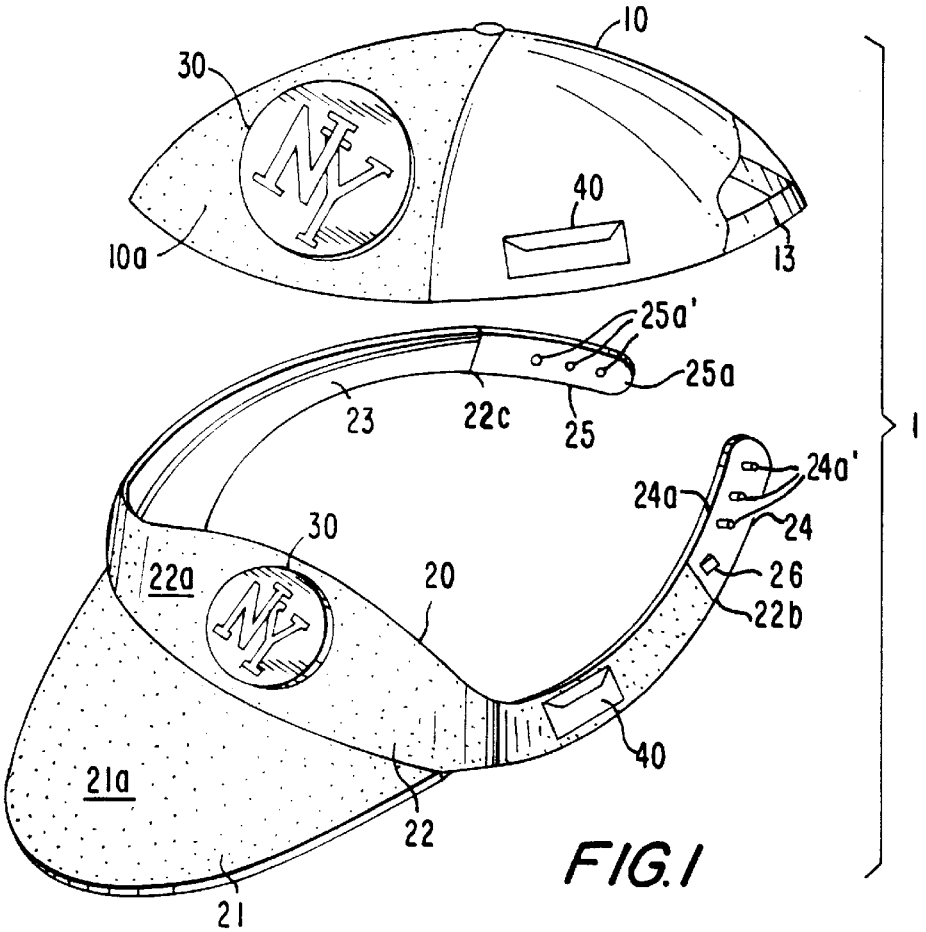
FIG. 1 is a front exploded, partially fragmented perspective view of a first preferred embodiment of the segmented cap of the present invention.

FIG. 1 illustrates in an exploded front perspective view a first preferred embodiment of a segmented cap assembly 1 constructed in accordance with the teachings of the present invention. First segmented cap assembly 1 generally includes a crown component 10, a visored headband component 20 and an ornamental badge 30. Crown component 10 is selectively attachable to visored headband component 20, and ornamental badge 30 is selectively attachable to either crown component 10 or headband component 20, as hereinafter described in greater detail.

Figure 2:
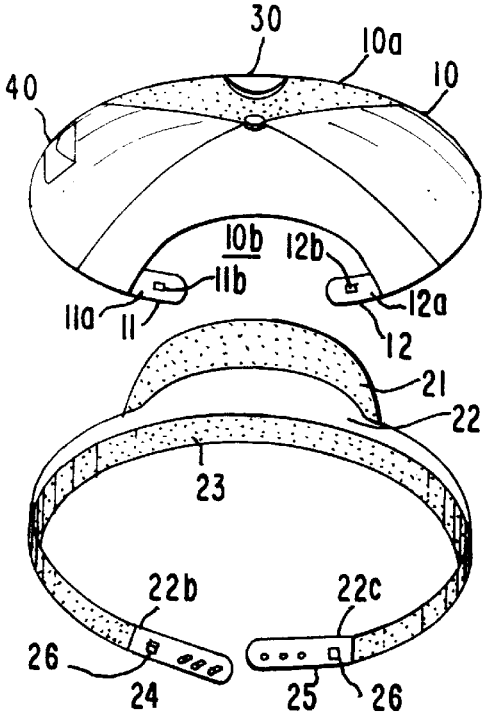
FIG. 2 is a rear exploded perspective view of the first preferred embodiment of the segmented cap.
Figure 3:
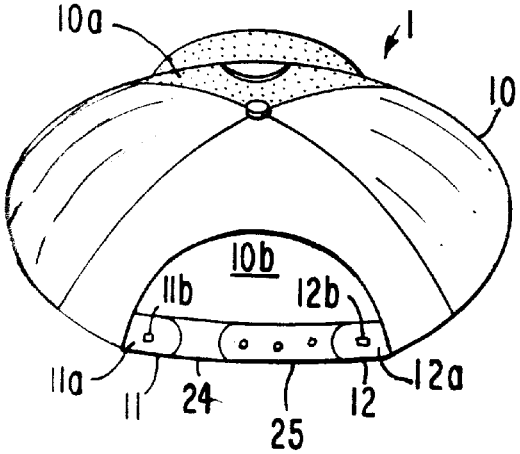
FIG. 3 is a rear perspective view showing the crown component attached to the visored headband component.

Crown component 10 comprises a body of flaccid material having at least a portion thereof formed from hook and loop tape hook-portion-engaging material 10*a*. As can be seen in FIGS. 2 and 3, the rear portion of crown component 10 is formed having an arched opening 10*b*. First and second crown component engagement tabs 11, 12 are fixedly attached to respective lower edges of the arched opening 10*b* of crown component 10. Engagement tabs 11, 12 preferably comprises respective extending members 11*a*, 12*a* having respective openings 11*b*, 12*b* formed therein. Crown component engagement tabs 11, 12 facilitate attachment of crown component 10 to visored headband component 20 as hereinafter described.

Referring again to FIG. 1, it can be seen that visored headband component 20 includes a bill portion 21, a forehead portion 22, and a sweatband portion 23. Bill portion 21 is preferably formed having an upper surface 21*a* formed from hook and loop tape hook-portion-engaging material. Forehead portion 22 is likewise formed having a forward face 22*a* formed from hook-portion-engaging material. Forehead portion 22 is fixedly attached at the lower edge thereof to the bill portion 21 and extends beyond respective sides of said bill portion 21 to first and second distal ends 22*b*, 22*c*. Said distal ends 22*b*, 22*c* may be attached to each other by use of a section of the hook portion of hook and loop tape disposed on a rearward face of the forehead portion 22 approximate to one of the distal ends 22*b* or 22*c*. In the first preferred embodiment, however, first and second cooperably-engaging headband component attachment tabs 24, 25 are respectively and fixedly attached to the first and second distal ends 22*b*, 22*c* of forehead portion 22. The respective headband component attachment tabs 24, 25 preferably comprise extending members 24*a*, 25*a* having raised protrusions 24*a*' disposed on the first attachment tab 24 and openings 25*a*' formed in the second attachment tab 24, said protrusions 24*a*' being receivable in said openings 25*a*'. Said first and second attachment tabs 24, 25 further include crown engagement tab attachment means 26 disposed adjacent to the attachment of said attachment tabs 24, 25 to said first and second distal ends 22*b*, 22*c* of forehead portion 22. The crown engagement tab attachment means 26 are selectively receivable in the openings 11*b*, 12*b* formed in the extending members 11*a*, 12*a* of the crown component engagement tabs 11, 12 of said crown component 10 (FIG. 3). Sweatband portion 23 comprises a length of moisture-absorbent material and is fixedly attached to the bill portion 21 opposite the attachment of said forehead portion 22. Sweatband portion 23 extends upwardly therefrom to the inside of the forehead portion 22.

Figure 4:
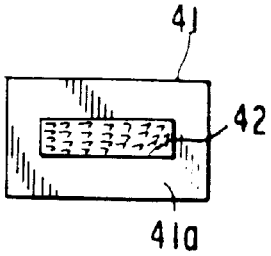
FIG. 4 is a rear elevational view of a selectively attachable pocket.

As further shown in FIG. 1, first segmented cap 1 includes a pocket 40 fixedly attached to the forehead portion 22 of visored headband component 20. As can be seen in FIG. 4 a selectively attachable pocket 41 may be formed having a strip of the hook portion 42 of hook and loop tape material fixedly attached to a rear face 41*a* of pocket 41. Said strip of hook portion 42 permits selective attachment of pocket 41 to the hook-portion-engaging material of crown component 10 or the bill portion 21 or forehead portion 22 of the visored headband component 20.

Figure 5:
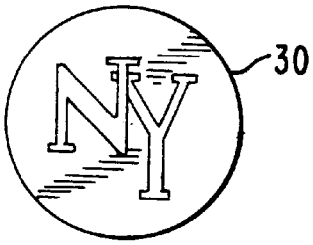
FIG. 5 is a front elevational view of an ornamental badge.
Figure 6:
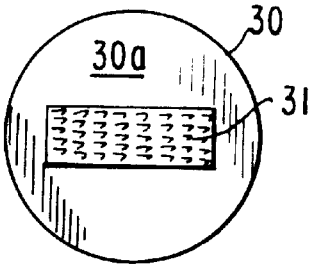
FIG. 6 is a rear elevational view of an ornamental badge.
Figure 7:
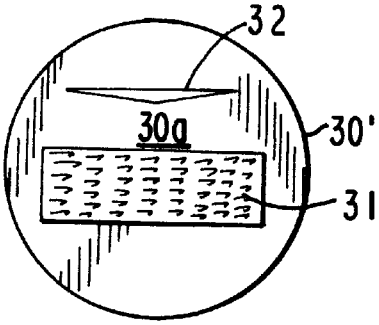
FIG. 7 is a rear elevational view of an alternative ornamental badge.

FIG. 5 illustrates a front elevational view of an ornamental badge 30. Ornamental badge 30 may be formed in any of a variety of shapes and ornamental designs. Badge 30 includes a strip of the hook portion 31 (FIG. 6) of hook and loop tape material fixedly attached to a rear face 30*a* of badge 30 for selective attachment to crown component 10 or headband component 20. An alternative badge 30' is shown in FIG. 7 wherein a pocket 32 is formed therein.

Figure 8:
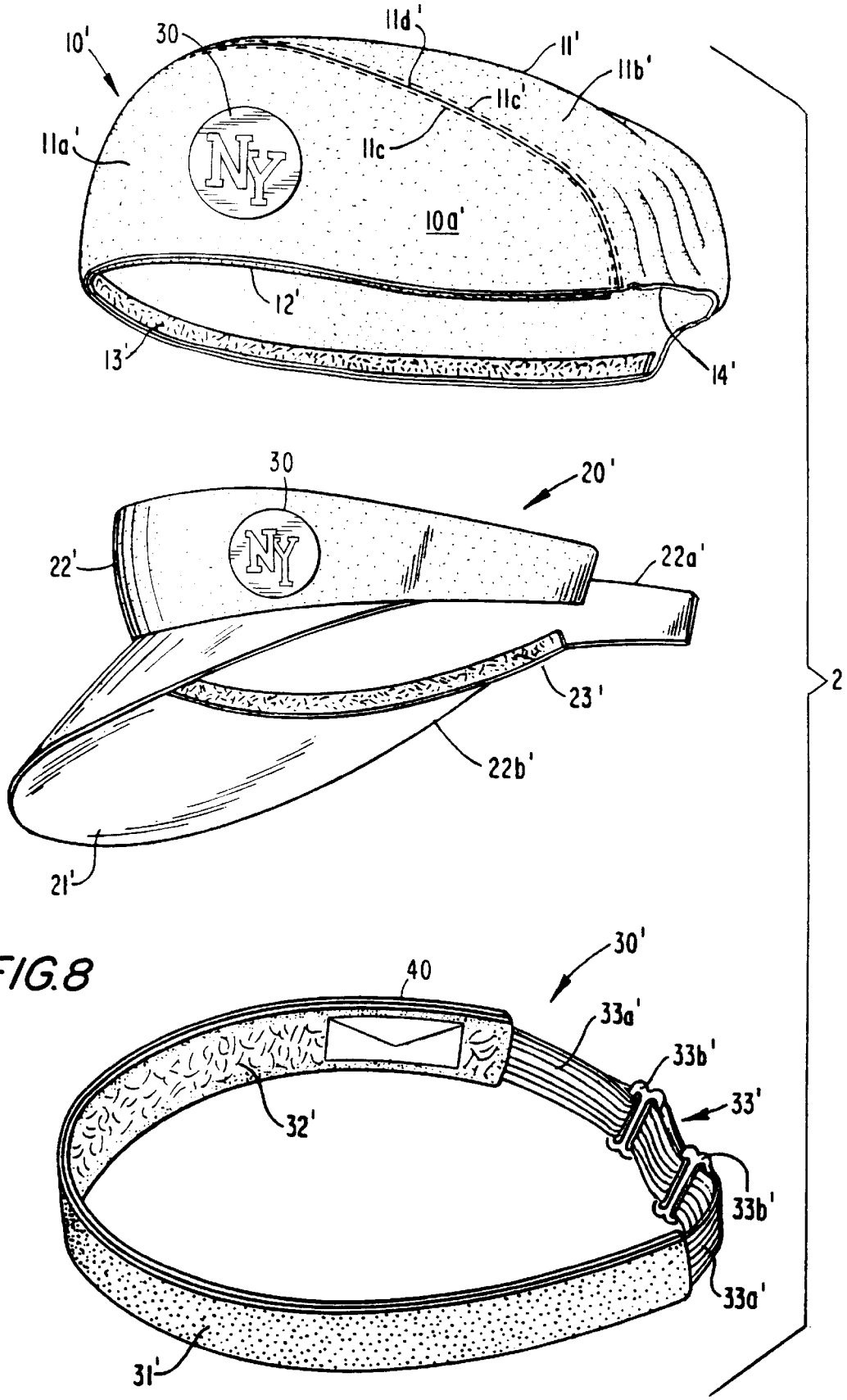
FIG. 8 is an exploded side perspective view of a second preferred embodiment of the segmented cap assembly of the present invention.

FIG. 8 illustrates in an exploded perspective view a second preferred embodiment of a segmented cap assembly 2 constructed in accordance with the teachings of the present disclosure. Second segmented cap assembly 2 includes a crown component 10', a visor component 20', and a sweatband component 30'. Each of the several components 10', 20', 30' are detachably connectable to each other as hereinafter described in greater detail.

Crown component 10' of second segmented cap assembly 2 generally comprises a body of flaccid material 11' having a hemmed lower edge 12' and a length of the hook portion 13' of hook and loop tape material, such as the material sold under the trademark VELCRO, fixedly attached to the inside portion of the body of flaccid material 11' adjacent to the hemmed lower edge 12' forming crown attachment means 13'. In the second preferred embodiment of the segmented cap assembly 2 the crown component 10 includes side crown portions 11*a*' and a central crown portion 11*b*', said side crown portions 11*a*' being attached to respective sides of said central crown portion 11*b*' by stitching means 11*c*' to form smooth seams 11*d*' therebetween. The crown attachment means 13 extends between the respective seams 11*d*' at the rear part of the crown component 10' in a continuous length around the side crown portions 11*a*' and the forward part of the central crown portion 11*b*'. A length of elastic material 14' is fixedly attached along the rear part of the central crown portion 11*b*' at the hemmed lower edge 12' thereof to provide means for head size adjustment of the crown component 10'. At least a portion of the outside surface 10*a*' of crown component 10', for example a side crown portion 11*a*' is preferably formed from hook-portion-engaging material for attachment of an ornamental badge 30 thereto.

Visor component 20' comprises integrally-formed bill portion 21' and forehead portion 22'. The forehead portion 22' extends substantially vertical from the bill portion 21' and is preferably formed from hook-portion-engaging material for selective receipt of an ornamental badge 30. Visor component 20' further includes a length of the hook portion 23' of hook and loop tape material, such as the material sold under the trademark VELCRO, fixedly attached to the inside surface 22*a*' of the forehead portion 22' along the lower edge 22*b*' of the forehead portion 22' forming visor attachment means 23'.

Sweatband component 30' comprises a length of hook and loop tape hook portion-engaging material 31', as manufactured by Guilford Mills Inc. of New York, N.Y., fixedly attached back-to-back to a length of terrycloth material 32'. A limitation of the segmented caps in the prior art is the use of the hook portion of hook and loop tape material and the loop portion of hook and loop tape material on the respective components that are to be attached. Neither the hook portion nor the loop portion of hook and loop tape material can be easily printed upon and when exposed it does not present a neat and clean appearance. The use of hook and loop tape hook portion-engaging material 31' overcomes these limitations. Hook and loop tape hook-portion-engaging material 31' is a smooth, closely woven fabric which thusly can be printed on using conventional processes, and specifically adheres to the hook portion of hook and loop tape material, and therefore can replace the loop portion of hook and loop tape material. For head size adjustment of the sweatband component 30' an elasticized strap assembly 33' is fixedly attached to respective ends of the attached lengths of hook and loop tape hook-portion-engaging material 31' and terrycloth material 32'. Strap assembly 33' comprises a plurality of elastic bands 33*a*' interconnected in sliding engagement to adjustment clips 33*b*' as generally known in the art.

Figure 9:
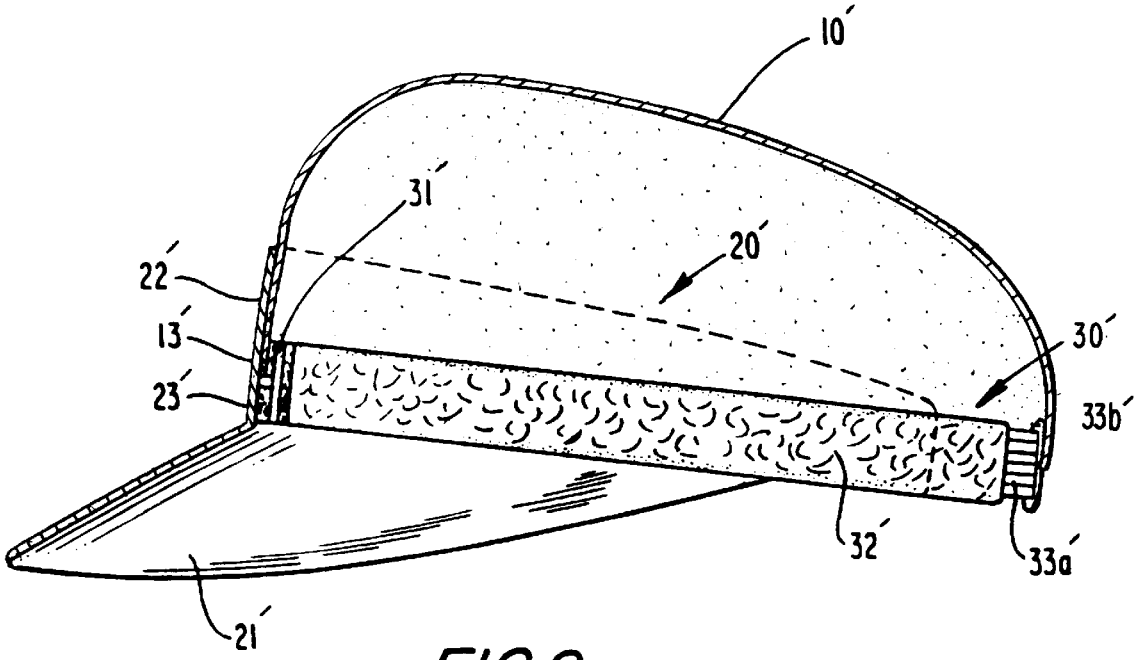
FIG. 9 is a side cross-sectional view of an assembled second segmented cap assembly.
Figure 10:
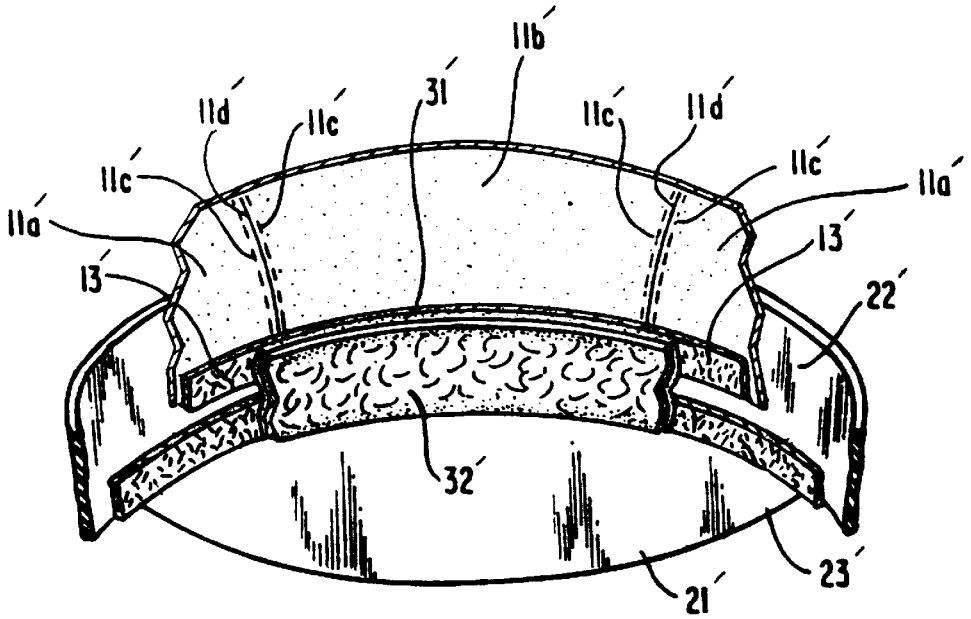
FIG. 10 is a partially fragmented rear perspective view of the second segmented cap assembly.

FIG. 9 illustrates in a side cross-sectional view the attachment of the crown component 10', the visor component 20' and the sweatband component 30'. The width of the sweatband component 30' is at least equal to the combined width of the crown attachment means 13' of the crown component 10' and the visor attachment means 23' of the visor component 20'. The forward part of the crown component 10' is disposed behind the forehead portion 22' of the visor component 20' having the crown attachment means 13' engaging the upper half of the length of hook and loop tape hook-portion-engaging material 31' of the sweatband component 30'. The visor attachment means 23' engages the lower half of the length of hook and loop tape hook-portion-engaging material 31' of the sweatband component 30' (FIG. 10). Thereby the three components 10', 20', 30' are held together to form an integrated cap assembly.

A particular advantage of the segmented cap assemblies 1 and 2 of the present invention is the provision of a cap comprising components that can be used separately for display of an ornamental badge 30 or printed matter, such as a company logo, trademark or tradename at the forehead of the wearer. The use of hook and loop tape hook portion-engaging material 31' in lieu of the loop portion of hook and loop tape material, as known in the prior art, on the forward face of the sweatband component 30', permits the sweatband component 30' to be worn alone and separate as a marketing tool. The prior art segmented caps using the loop portion of hook and loop tape material on the forward face of the sweatband can neither be printed on nor do they provide a neat and clean appearance that is marketable. To wear the visor component 20' with the sweatband component 30' to provide sun-shading means for the wearer's eyes via the bill portion 21' of the visor component 20', the visor attachment means 23' is attached to the hook and loop tape hook-portion-engaging material 31' of the sweatband component 30'. A company logo, trademark, tradename or ornamental badge 30 can thus be displayed on the forward face of the forehead portion 22' of the visor component 20'. To wear the crown component 10' without the visor component, the crown attachment means 13' is attached to the hook and loop tape hook-portion-engaging material 31' of the sweatband component 30'. Printed matter or ornamental badge 30 can then be displayed upon the body of flaccid material 11'.

Various changes and modifications may be made to the preferred embodiments of the present disclosure without departing from the spirit and scope of the present invention. Such changes and modifications within a fair reading of the following claims are intended as part of the present invention.

Therefore, in view of the foregoing I claim:

1. A segmented cap assembly comprising a crown component comprising a body of flaccid material, at least a portion of said body of material having a forward face formed from hook and loop tape hook-portion-engaging material, said crown component further including crown attachment means fixedly attached to an inside portion of said body of material; and a visored headband component comprising a bill portion, a forehead portion and a sweatband portion, said forehead portion being fixedly attached at a lower edge thereof to said bill portion and extending therefrom beyond respective sides of said bill portion, said sweatband portion being fixedly attached at a lower edge thereof to said bill portion and disposed to an inside of said forehead portion, said crown component being selectively attachable to said visored headband component by engagement of said crown attachment means to a forward face of said forehead portion.

2. A segmented cap assembly as in claim 1 wherein said crown attachment means comprises a strip of a hook portion of hook and loop tape material having the hooked face of the said hook portion outwardly disposed from said body of material, and the forehead portion of said visored headband component is formed from hook and loop tape hook-portion-engaging material.

3. A segmented cap assembly as in claim 2 wherein the bill portion of said visored headband component is formed from hook and loop tape hook-portion-engaging material.

4. A segmented cap assembly as in claim 3 further including at least one ornamental badge having a rearward face including a hook portion of hook and loop tape material, said ornamental badge being selectively attachable to the forward face of the crown component formed from hook and loop tape hook-portion-engaging material, the forehead portion of said visored headband component or the bill portion of said visored headband component.

5. A segmented cap assembly as in claim 4 wherein said ornamental badge includes a pocket.

6. A segmented cap assembly as in claim 1 further including at least one pocket formed in said crown component.

7. A segmented cap assembly as in claim 1 further including at least one pocket selectively attachable to said crown component.

8. A segmented cap assembly as in claim 1 further including at least one pocket formed in said visored headband component.

9. A segmented cap assembly as in claim 1 further including at least one pocket selectively attachable to said visored headband component.

10. A segmented cap assembly comprising a crown component, said crown component comprising (a) a body of material having crown attachment means fixedly attached to an inside portion of said body of material, said body of material having an arched opening formed at a rear edge thereof, and (b) first and second crown component engagement tabs fixedly attached to respective lower edges of said arched opening; and a visored headband component, said headband component comprising (a) a bill portion, (b) a forehead portion, (c) a sweatband portion, said forehead portion being fixedly attached at a lower edge thereof to said bill portion and extending therefrom beyond respective sides of said bill portion to first and second distal ends of said forehead portion, said sweatband portion being fixedly attached at a lower edge thereof to said bill portion and disposed to an inside of said forehead portion, and (d) first and second cooperably-engaging headband component attachment tabs fixedly attached to the respective first and second distal ends of said forehead portion, said attachment tabs having crown component engagement tab attachment means, said crown component being selectively attachable to said visored headband component by engagement of said crown attachment means to a forward face of said forehead portion and by attachment of said crown component engagement tabs to said crown component engagement tab attachment means.

11. A segmented cap assembly as in claim 10 wherein at least a portion of said body of material includes a forward face formed from hook and loop tape hook-portion-engaging material.

12. A segmented cap assembly as in claim 10 wherein said crown attachment means comprises a strip of a hook portion of hook and loop tape material and the forehead portion of said visored headband component is formed from hook and loop tape hook-portion-engaging material.

13. A segmented cap assembly as in claim 12 wherein the bill portion of said visored headband component is formed from hook and loop tape hook-portion-engaging material.

14. A segmented assembly as in claim 12 further including at least one ornamental badge having a rearward face including a hook portion of hook and loop tape material, said ornamental badge being selectively attachable to the forehead portion of said visored headband component.

15. A segmented cap assembly as in claim 14 wherein said ornamental badge includes a pocket.

16. A segmented cap assembly as in claim 12 further including at least one pocket formed in said crown component.

17. A segmented cap assembly as in claim 12 further including at least one pocket formed in said visored headband component.

* * * * *